US005454223A

United States Patent [19]

Tschida et al.

[11] Patent Number: 5,454,223

[45] Date of Patent: Oct. 3, 1995

[54] HYDRAULIC LOAD SENSING SYSTEM WITH POPPET VALVE HAVING AN ORIFICE THEREIN

[75] Inventors: Donald W. Tschida, Roseville; Alvin S. Rost, Fridley, both of Minn.

[73] Assignee: Dana Corporation, Toledo, Ohio

[21] Appl. No.: 68,675

[22] Filed: May 28, 1993

[51] Int. Cl.[6] ..... F16D 31/02; F16K 17/04

[52] U.S. Cl. ..... 60/450; 60/452; 137/513.3; 137/596.13

[58] Field of Search ..... 60/445, 452, 468, 60/450; 91/518; 137/596.13, 513.3 X

[56] References Cited

U.S. PATENT DOCUMENTS

| | | | |
|---|---|---|---|
| 2,622,613 | 12/1952 | McNeal . | |
| 3,769,800 | 11/1973 | Winter | 60/445 |
| 3,865,514 | 2/1975 | Lonnemo | 60/452 X |
| 3,915,253 | 10/1975 | Ott et al. | 60/452 X |
| 3,995,425 | 12/1976 | Wittren | 60/452 X |
| 4,197,705 | 4/1980 | Westveer | 60/445 |
| 4,293,284 | 10/1981 | Carlson et al. | 60/450 X |
| 4,344,285 | 8/1982 | Ridge | 60/452 |
| 4,463,558 | 8/1984 | Miller et al. | 91/518 X |
| 4,481,770 | 11/1984 | Lohbauer et al. | 60/452 |
| 4,512,723 | 4/1985 | Williams . | |
| 4,665,699 | 5/1987 | Krusche | 60/452 |
| 4,745,747 | 5/1988 | Krausse et al. | 60/452 |
| 4,815,289 | 3/1989 | Williams . | |
| 5,000,001 | 3/1991 | Christensen et al. . | |
| 5,067,389 | 11/1991 | St. Germain | 60/445 X |
| 5,077,975 | 1/1992 | Kauss | 60/452 |
| 5,138,837 | 8/1992 | Obertrifter et al. | 137/596.13 X |
| 5,152,140 | 10/1992 | Hirata et al. | 60/452 X |
| 5,305,789 | 4/1994 | Rivolier | 60/452 |
| 5,337,778 | 8/1994 | Thomsen et al. | 137/596.13 X |

FOREIGN PATENT DOCUMENTS

| | | | |
|---|---|---|---|
| 0154502 | 9/1982 | Japan | 60/452 |
| 59-55931 | 3/1984 | Japan | 60/452 |

*Primary Examiner*—John E. Ryznic

*Attorney, Agent, or Firm*—Millen, White, Zelano & Branigan

[57] ABSTRACT

An improvement in and method of operating a load sensing system in which a variable displacement, pressure compensated pump delivering hydraulic fluid to a fluid operating device through a directional control valve is controlled by a load-sensing system pressure limiter which is set so that the system operates at the maximum continuous system operating pressure. By also setting pump destroke pressure slightly higher than the necessary operating pressure for the load, optimum performance of the pump is realized. The load-sensing system pressure limiter is configured as a poppet which is placed inside of the body of the directional control valve and is biased by an adjustable spring force to the closed position. Preferably, the poppet connects the load sensing core of the directional control valve to an exhaust passage therein so as to require minimal modification of the directional control valve. In a preferred embodiment, the poppet has a bleed-down orifice extending therethrough to unload the load pressure signal when work has been completed or diminished.

6 Claims, 4 Drawing Sheets

HYDRAULIC LOAD SENSING SYSTEM WITH POPPET VALVE HAVING AN ORIFICE THEREIN

BACKGROUND OF THE INVENTION

1. Field of the Invention

In general, this invention relates to improvements in and a method of operating a hydraulic load sensing system. In particular, this invention relates to hydraulic load sensing systems wherein the pressure of either a load sensing control valve or a load-sensing, pressure-compensated control valve is regulated to improve the efficiency of a hydraulic system.

2. Background Art

Devices such as power shovels, loaders, bulldozers, hydraulic lifts, and the like rely on hydraulic cylinders and motors in order to perform their various functions. The hydraulic cylinders or motors are powered by a hydraulic pump, such as a swash plate pump, which is connected through a fluid control valve generally operated directly or indirectly by manually manipulated handles or the like which control flow of hydraulic fluid to the hydraulic cylinders or motors.

The directional control valves generally include a body having a pressure port which is connected to the pump; tank ports which are connected to a tank or reservoir for hydraulic fluid, and work ports connected to one or more hydraulic cylinders. The operating handles selectively connect various ports with one another in order to control operation of the hydraulic cylinders so that fluid is delivered to the cylinders and exhausted from the cylinders in accordance with the operator's purposes. Fluid control valves under consideration with respect to this invention include a body having a bore formed therein which receives a spool with a plurality of circumferential grooves thereon. The various ports are in communication with the bore via passageways which are selectively connected by positioning the spool axially within the bore.

Generally, directional control valves are classified as open center systems, closed center systems, and load sensing systems. Open center systems are relatively inexpensive, uncomplicated, and imprecise, whereas closed center systems are responsive and precisely controllable but relatively expensive. Both open and closed center systems tend to be inefficient. Load sensing systems, which are the subject of this invention, tend to be relatively efficient because the pump which generates the flow of fluid to the fluid control valve delivers that fluid at a variable flow rate and at a variable output pressure based upon the instantaneous requirements of the device controlled by hydraulic cylinders connected to the directional control valve. This is accomplished by providing a feedback signal to the pump which is representative of the fluid pressure required to operate the control device and controlling the output pressure from the pump to assume a predetermined magnitude greater than the feedback signal. In that the predetermined pressure differential between the operating pressure and required pressure is relatively small, the efficiency of a load sensing hydraulic system is much higher than the efficiency of open center and closed center systems. Directional control valves having a compensating structure for controlling the pressure differential thereacross, and consequently the flow of fluid thereto, are generally referred to as load sensing or pressure compensating valves.

The load sensing or pressure compensating valve may be either a prepressure compensated valve or a post-pressure compensated valve. In post-pressure compensated valves, the compensator is positioned between the spool and the output work port of the fluid control valve to regulate the pressure of the fluid supplied from the spool to a predetermined magnitude less than the pressure of the fluid at the inlet pressure port but greater than the pressure of the fluid in the active work port. Accordingly, a constant pressure differential is maintained across the spool, resulting in a constant flow of fluid therethrough, regardless of changing load requirements. A number of postpressure compensator structures are known in the art; however, these known arrangements are rather complicated and/or require a number of components, and therefore are relatively expensive or difficult to service. Moreover, employment of post-pressure compensators can be further improved by having the components function so that maximum system operating pressure is adjusted, whereby maximum pump output flow is achieved at maximum system operating pressure.

SUMMARY OF THE INVENTION

It is a feature of the instant invention to provide a more energy-efficient hydraulic system with greater longevity by providing a load sensing and system pressure limiting valve which is inexpensive to incorporate into existing directional control valve arrangements.

In view of this feature and other features, the present invention is directed to an improvement in a directional control valve for controlling the distribution of fluid from a variable displacement, pressure-compensated pump to at least one fluid-operated device. The directional control valve includes passages for fluid inlet and passages for fluid exhaust, as well as work ports connected to the fluid-operated device for delivering pressurized fluid thereto. A load-sensing line is connected to a pressure compensator within the pump and to a fluid passage in communication with the work ports in the control valve for delivering a load sense fluid signal to the pressure compensator. The load-sensing line is connected to a system pressure limiter disposed between the load sense line and the exhaust line for relieving the load sense signal when the load sense signal exceeds a selected level, facilitating operating the system at the maximum continuous operating pressure of the system.

Preferably, the load-sensing system pressure limiter is disposed within the body of the control valve and connected directly to the load sensing passage in the control valve, as well as to the exhaust core in the control valve. Optionally, a bleed orifice is provided in a pressure relief poppet which comprises the system pressure limiter.

The present invention is also directed to a method of operating a hydraulic system in which a load driven by a pressure-compensated pump is controlled by a directional controller which includes a load-sensing, system pressure limiter in the form of a relief valve. In accordance with the method, the relief valve is set to control the maximum system operating pressure by controlling the load sense pressure signal sent to a pump operating, pressure destroke valve. The pressure setting of the relief valve is set just high enough so as to not start to become active at the maximum system operating pressure.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views and wherein.

DETAILED DESCRIPTION

Figure 1:
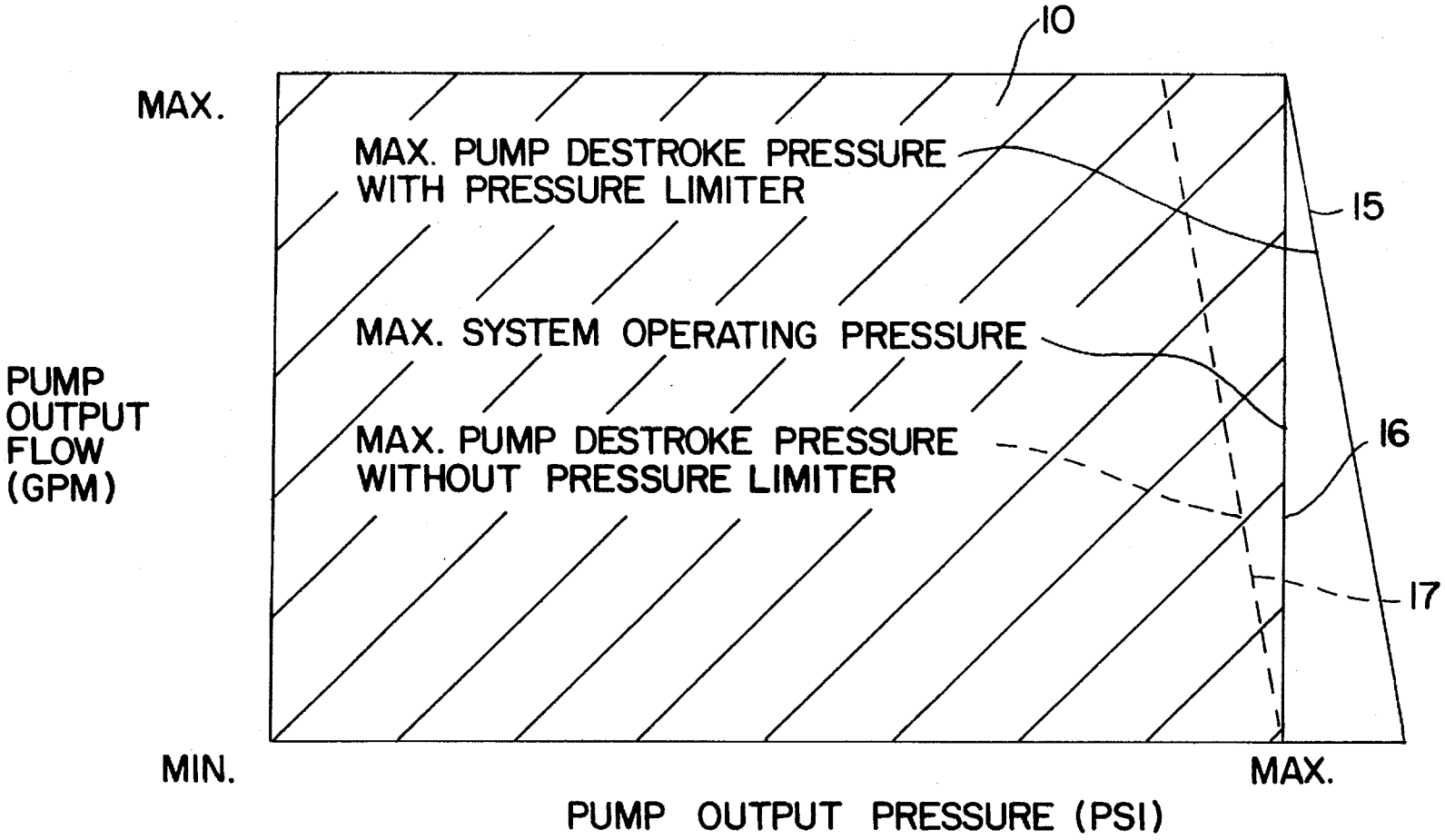
FIG. 1 is a graph plotting hydraulic fluid flow as a function of pressure.

Referring now to FIG. 1, there is shown a graph plotting pressure (psi) as a function of hydraulic flow in gallons per minute. The graph includes an area 10, representing maximum system capacity. The present invention improves performance as well as prolonging the life of components comprising hydraulic systems. As will be further explained hereinafter, the present invention sets the destroke pressure of the pump (line 15) higher than the operating pressure (line 16) required by the devices operated by the system. In addition, the system adjusts the maximum system operating pressure (line 16) with a pressure limiter so that maximum pump output flow can be achieved at maximum system operating pressure. In accordance with the present invention, the normal pump characteristic of reducing output flow as destroke pressure is approached is eliminated (FIG. 1, line 17), which allows full system performance at maximum system pressure. Moreover, by providing a bleed-down orifice, the system is able to destroke quickly when the valve's work function is complete or when work has diminished.

Figure 2:
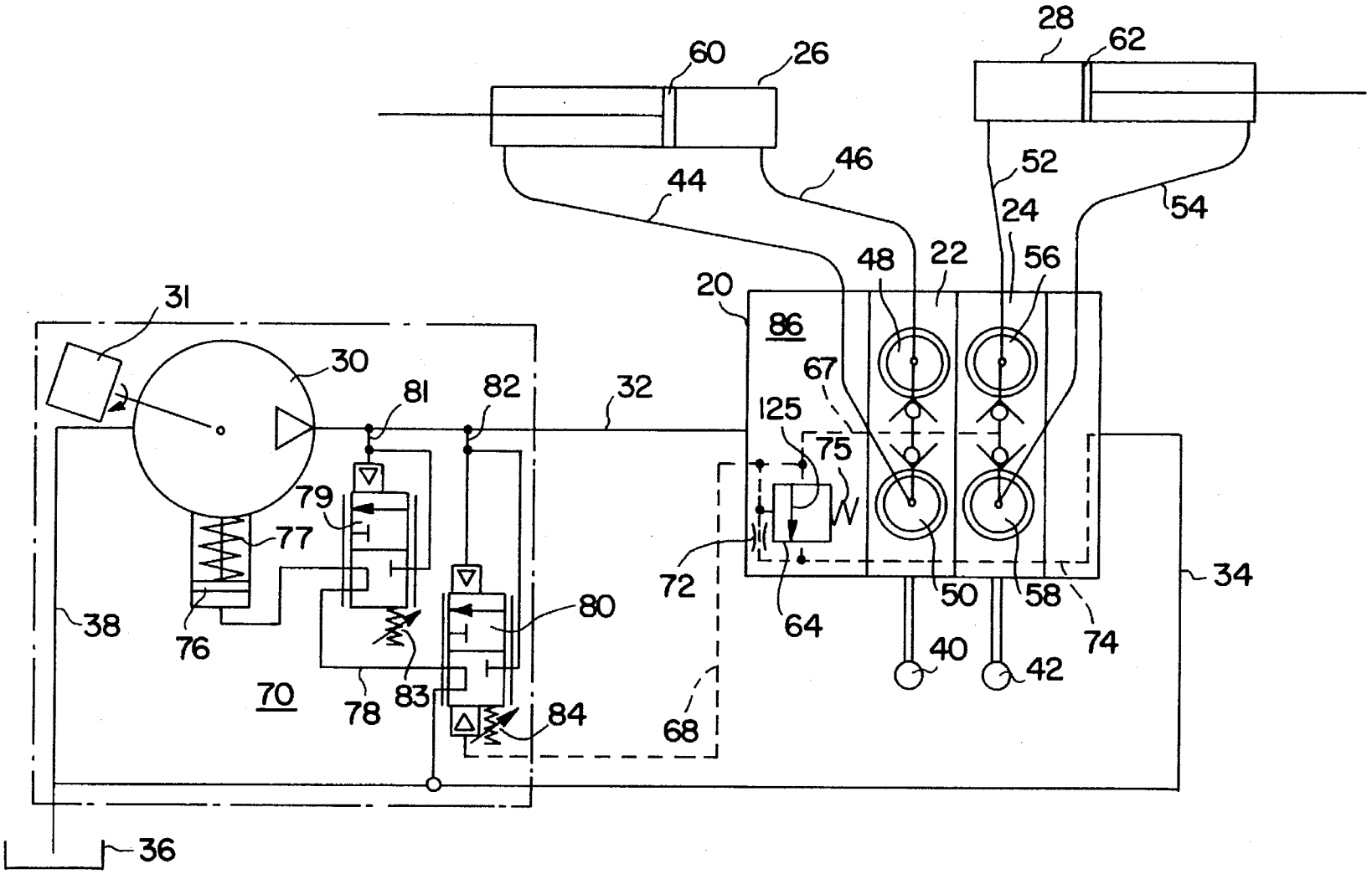
FIG. 2 is a diagrammatical illustration of a hydraulic circuit configured in accordance with the principles of the instant invention, wherein a load-sensing pressure limiter is employed.

Referring now to FIG. 2, there is shown a directional control valve 20 having first and second individual work sections 22 and 24. The work section 22 is connected to a first hydraulic cylinder 26 while the work section 24 is connected to a second hydraulic cylinder 28. A variable displacement, swash plate pump 30 driven by a motor 31 provides pressurized hydraulic fluid over a line 32 to the directional control valve 20. When the directional control valve 20 is in a neutral mode, the pressurized hydraulic fluid in inlet line 32 passes through the control valve 20 and is blocked after passing through sections 22 and 24.

When it is desired to activate one or both of the hydraulic cylinders 26 and 28, manual operating handles 40 and 42 are moved to selectively directing the hydraulic fluid in line 32 to flow out through either lines 44 or 46 connected to work ports 48 and 50 in section 22 of the directional control valve 20 or through lines 52 or 54 connected to work ports 56 or 58 in the second section 24 of the directional control valve. In each case, hydraulic fluid is returned to the reservoir 36 through line 34 and, thereafter, hydraulic fluid is returned by pump inlet line 38 to the pump 30 and continues to circulate while the work device is being powered by the hydraulic cylinders 26 and 28.

In accordance with the principles of the instant invention, the output pressure with pressure loads imposed by pistons 60 and 62 in the cylinders 26 and 28, respectively, are sensed by a load-sensing system pressure limiter 64, which is connected by a passage 66 to load sense passage 67 communicating with the ports 48 and 50 in section 22 of the directional control valve 20 and to ports 56 and 58 in the second section 24 of the directional control valve. The load-sensing system pressure limiter 64, is also connected by a line 68 to a pump pressure compensator 70 associated with the variable displacement pump 30. The system pressure limiter 64 also has a bleed-down orifice 72 therein connected by an exhaust cavity 74 to the exhaust line 34 so as to dump into the tank 36.

In accordance with the principles of the instant invention, the load-sensing pressure limiter 64 is spring biased by a spring 75 to open at a selected load pressure imposed by the one or both of the pistons 60 and 62 in the hydraulic cylinders 26 and 28. The spring 75 is set so that the load sensing signal over line 66 is relieved through the exhaust cavity 74 of the valve 20 when the pressure is such as to overcome the spring. The spring 75 is set at the maximum continuous operating pressure of the system while the destroke pressure of the pump 30 is set slightly higher than the maximum continuous operating pressure. The bleed-down orifice 72 associated with the load-sensing pressure limiter 64 allows the system to unload the pressure signal on line 68 (FIG. 2) through the exhaust cavity 74 when work performed by the cylinders 26 and 28 has been completed or is diminished. As will be further explained hereinafter, the force exerted by the spring 75 can be conveniently adjusted to optimize the pressure at which the load sense signal is relieved. Moreover, the load-sensing pressure limiter 64 can be conveniently incorporated within the body of the directional control valve 20 so as to connect directly with the passage 66 connected to the load sense passage 67 and exhaust cavity 74 of the directional control valve.

The pressure compensator 70 is integral with or forms an assembly with the swash plate pump 30. The swash plate pump 30 is of a conventional configuration in that it includes a plurality of pistons (not shown) mounted in a piston block (not shown). The length of the strokes of the pistons are controlled by a cam plate (not shown) from zero length to a maximum length. When the stroke has a zero length, the pistons are not pumping hydraulic fluid, and the pump 30 is in what is conventionally known as a "destroking" mode, wherein the motor 31 is rotating the pump elements, but no fluid is flowing out of the outlet line 32.

The cam plate (not shown) in the pump 30 is operated by a destroke piston 76, which is normally biased to the illustrated full stroke position by a spring 77 so that the pump 30 pumps a maximum capacity of hydraulic fluid with each stroke. If the four-way, directional control valve 20 is in the idle or non-operating mode, the hydraulic fluid is blocked but is available immediately upon activation of the pistons 60 and 62 in the hydraulic cylinders 26 and 28 if the handles 40 or 42 are operated.

When the destroke piston 76 is the illustrated fullstroke position, a hydraulic line or passage 78 is connected through to the exhaust line 34 through a high pressure destroke valve 79 and an operating pressure destroke valve 80 connected in series. Both the high pressure destroke valve 79 and the operating pressure stroke valve 80 are connected via hydraulic lines 81 and 82, respectively, to the pump outlet line 32 so that pump outlet pressure destrokes the pump 30 upon operating either of the destroke valves to connect lines 81 and 82 while closing line 78 to exhaust line 34.

The operating pressure destroke valve 80 controls the pump output pressure in line 32. When the force of a spring 84 plus the force generated by the pressure in the load sense line 68 is equalled or exceeded by the force generated by the pressure in line 82, valve 80 disconnects line 78 from line 34 and connects line 78 to line 82 causing destroke piston 76 to reduce stroke and maintain pressure in line 32 equal to the pressure in line 68 plus the pressure equal to the force generated by the spring 84.

For example, if the maximum selected system operating pressure is to be 3000 psi (FIG. 1, ordinate line 16), the system pressure limiter 64 would be adjusted to control the pressure in load sense line 68 at 2700 psi by adjusting spring 75. By controlling the pressure in line 68 at 2700 psi and combining the 2700 psi pressure with a 300 psi spring force on spring 84, the maximum system operating pressure in line 32 is 3000 psi. Consequently, the valve 80 is set to open at a maximum system operation pressure of 3000 psi.

Considering again the high pressure destroke valve 79, the adjustable spring 83 determines the destroke pressure. The adjustable spring 83 is set to keep the destroke pressure at a level above the maximum system operating pressure which is necessary to operate the devices, such as hydraulic lifts or bulldozer blades (for example, 3000 psi), by the hydraulic cylinders 26 and 28 of the system. If the pump pressure on line 32 exceeds the maximum system operating pressure, the high pressure destroke valve closes the path from line 78 to line 34 and opens the path from destroke piston 76 so as to reduce stroke and maintain pressure in line 32 (FIG. 1, line 15).

Figure 3:
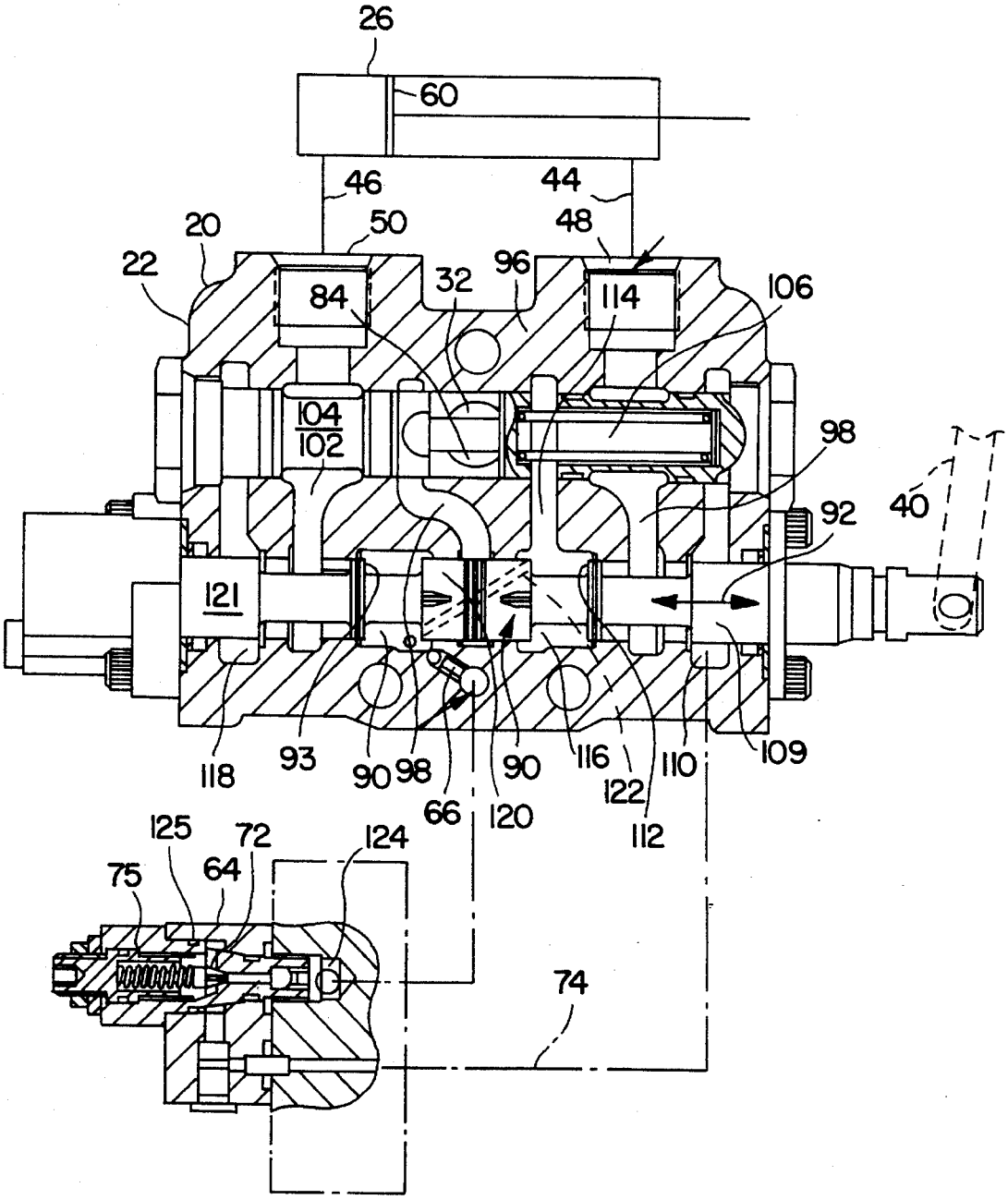
FIG. 3 is an elevational view of one dual directional control valve utilized with the hydraulic circuit of FIG. 2 having a load-sensing pressure limiter integral with the body of the valve.

Referring now to FIG. 3, the first section 22 of the directional control valve 20 is shown in elevation. The second section 24 (FIG. 2) is substantially identical to the first section but controls the second hydraulic cylinder 28 rather than the first hydraulic cylinder 26. Each of the sections 22 and 24 include a valve spool 90 which is axially shiftable in the direction of arrow 92 by whichever one of the operating levers 40 and 42 is connected thereto.

In FIG. 3, the valve spool 90 is in a neutral position and is blocked internally in valve 20. When the system is idling, pressure is almost instantaneously available to move the piston 60 within the hydraulic cylinder 26 upon moving the operating lever 40 to axially shift the valve spool 90. As is seen in FIG. 3, the inlet line 32 is connected to power core 98 defined in the body 96 of the directional control valve 20. When the valve spool 90 is shifted to the right by operating lever 40, spool land 97 unseats from the valve body allowing pressurized hydraulic fluid to flow into core 102 around the cylinder 104 and out of the work port 50 which moves piston 60 and the cylinder 26 to the right. Hydraulic fluid to the right of piston 60 is then exhausted through line 44 into work port 48 and from work port 48 around valve element 106, into passage 108 and thereafter into an exhaust passage 110. The exhaust passage 110 is connected by line 34 (FIG. 2) to the tank or reservoir 36 (FIG. 2).

In order to move the piston 60 in the hydraulic cylinder 26 to the left, the operating lever 40 moves the valve spindle 90 to the left. This moves spool land 112 from its seat with the body 96 allowing pressurized fluid applied over line 32 by the pump 30 (FIG. 2) to pass into the power core 98 and into power core 116 where it flows around the spool land 112 and up the passage 108 so as to flow out of the work port 48. The cylinder 109 is moved to the left in order to continue to block the exhaust passage 110. Consequently, hydraulic pressure is applied to the back of piston 60, which pressure moves the piston 60 to the left. As the piston 60 moves to the left, hydraulic fluid flows out of the hydraulic cylinder 26 through a line 46, into the port 50, around the cylinder 104 and into the passage 102. The passage 102 is connected to another portion 118 of the exhaust passage when a second cylindrical portion 121 of the valve spool 90 moves to the left, connecting the passage 102 to the second exhaust passage.

In accordance with the arrangement of FIG. 3, the load-sensing system pressure limiter 64 is incorporated into the body 96 of the directional control valve 20, as is passage 66, which connects the pressure limiter 64. Core 108 is also connected to the opposed core 116 by a bore 122 extending through the valve spool 90, which isolates the work ports 48 and 50 from one another. The load sensing line 68 which is connected directly to the pump compensator 70 (FIG. 1) also communicates directly with the load sensing limiter 64 by a cavity 124. When the pressure exerted by the load on the piston 60 in hydraulic cylinder 26 exceeds a selected level, the force of spring 75 is overcome causing a poppet 125 in the load sensing limiter 64 to open, allowing the hydraulic fluid in line 66 to pass via passageway 74 to the exhaust passage 110 and then to the reservoir 36 via line 34 (see FIG. 2).

Figure 4:
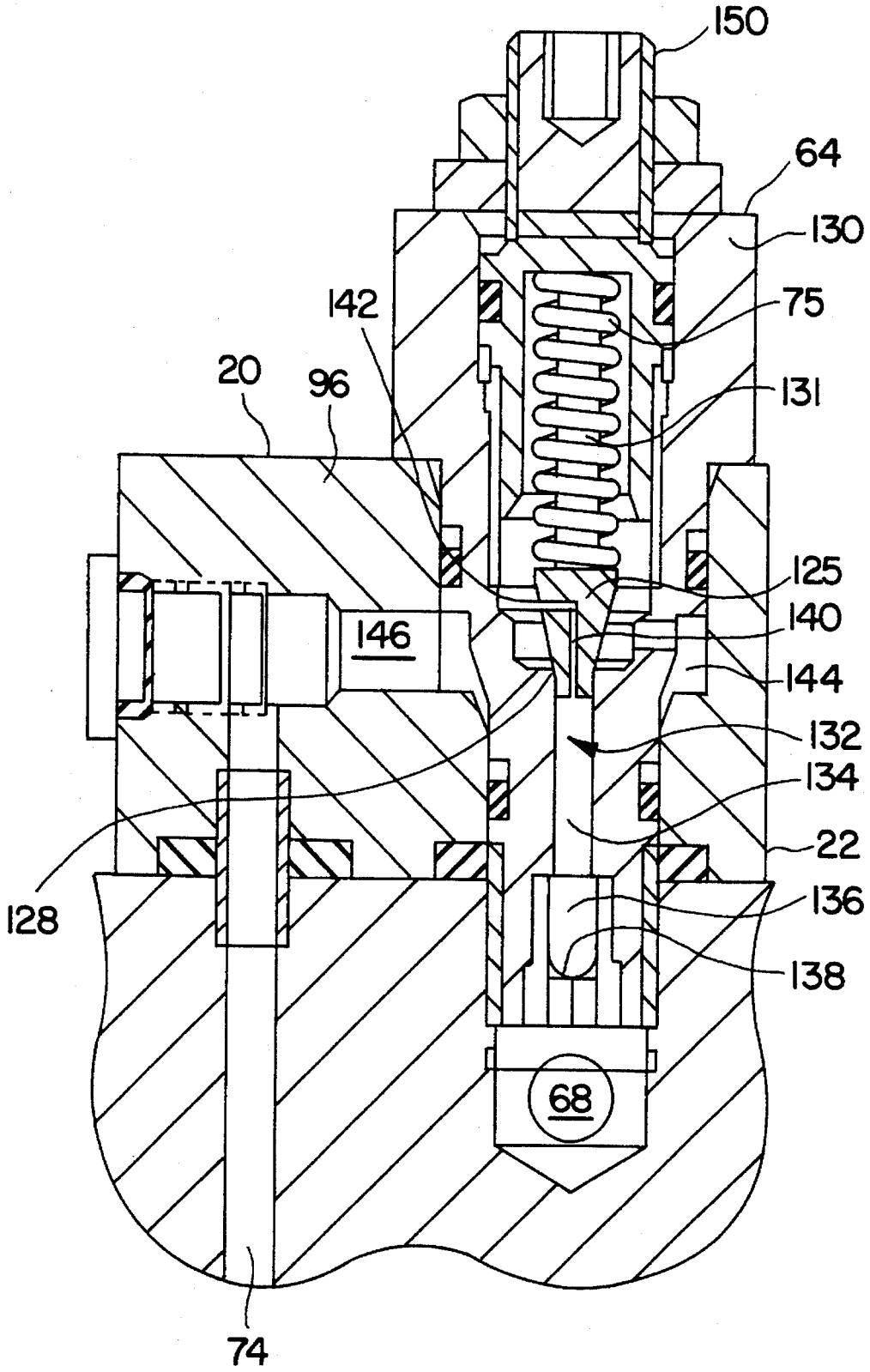
FIG. 4 is an enlarged view of the pressure limiter employed in FIG. 3.

Referring now more specifically to FIG. 4, where the structure of the load sensing, system pressure limiter 64 is shown in greater detail, it is seen that the load sensing limiter 64 is comprised of a body portion 130 which is seated in the body 96 of directional control valve 20. The spring 75 (see also FIGS. 2 and 3) urges the poppet 125 against seat 128. The poppet 125 has a stem 131 which is received within the coils of the spring 75 so as to radially stabilize the poppet. Under the bias of the spring 76, the poppet 125 normally closes a bore 132 extending within the body 130, which bore has a narrow portion 134 and a relatively wide portion 136. Disposed within the wide portion 136 of the bore 132 is a filter 138 which filters hydraulic fluid applied over the load sense line 68 (FIG. 2) prior to the hydraulic fluid entering the bore 132. The hydraulic fluid entering the bore 132 is filtered so as to ensure that the bleed-down bore 72 in the poppet 125 does not become clogged.

The bleed-down bore 72 (see FIG. 2) also has a lateral portion 142 which connects with a passage 144 in the body 130. The passage 144 exhausts to passage 146 surrounding the body 130, which passage 146 is connected to the exhaust passage 74 (also see FIGS. 2 and 3). The force exerted by spring 75 is determined by a screw adjustment 150 which projects outside of the body portion 96 of the directional control valve 20. By rotating the screw adjuster 150 in one direction, the spring 75 is compressed so as to increase the force on the poppet 125 and by rotating the screw adjuster 150 in the opposite direction, the force exerted by the spring 75 on the poppet 125 is diminished. Thus, the maximum system operating pressure (ordinate line 16, FIG. 1) may be selected by setting the compression of spring 75 so that the pressure over line 68 (FIG. 2) is less than the pressure on line 66 whereby the pump compensator 70 is not reacting to the actual load sensing signal when the load sensing signal exceeds the level selected by adjustment of the force exerted by the spring 75 on the poppet 125. Accordingly, the energy required for a selected flow rate is along the line 16 in FIG. 1 rather than being along line 17 (if the pressure limiter 64 was not used). Consequently, the system operates at full flow at maximum system operating pressure.

While operating the system at full flow when at maximum system operating pressure and by setting the pump destroke pressure slightly higher than the operating pressure, for example (at ordinate line 15, Figure ), optimum performance of the pump 30 occurs. The bleed-down bore 72 in the poppet 125 results in the load sensing signal being removed quickly to destroke the pump 30 when a bleed-down orifice is not otherwise available in the directional control valve 20 or pump 30. By placing the bleed-down orifice 72 in the poppet 125, the bleed-down orifice is located between the load sensing signal on line 66 and the valve exhaust 74. Accordingly, no additional passages are required inside the body 96 of the directional control valve 20 to accommodate a bleed-down orifice.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a directional control valve for a fluid system wherein the directional control valve controls the distribution of fluid from a variable displacement pump, the pump having a pump pressure compensator connected thereto and to at least one fluid operated device and wherein the directional control valve includes passages for fluid inlet and passages for fluid exhaust as well as work ports connected to the fluid operated device for delivering pressurized fluid thereto, the system further including an internal load sense line connected to the pump pressure compensator and to a fluid passage in communication with the work ports for delivering a load sense fluid signal to the pump pressure compensator, the improvement comprising:

a load-sensing system pressure limiter disposed in the body of the control valve between the internal load sense line and the internal exhaust line for relieving the load sense signal when the load sense signal exceeds a selected level; the load sensing limiter including a popper disposed between the load sense line and the exhaust line, the poppet having a bleed down orifice therein connecting the load sense line to the exhaust line to remove the load sense signal to destroke the pump.

2. The improvement of claim 1, wherein the poppet includes a spring providing a force urging the poppet to the closed position, and means for adjusting the force exerted by the spring so that the poppet relieves the load sense pressure at less than the maximum operating pressure of the system.

3. The improvement of claim 1, wherein the load sensing, system pressure limiter is disposed between the internal load sensing passage and the body of the directional control valve and the internal exhaust passage in the body of the directional control valve.

4. The improvement of claim 1, wherein the fluid is hydraulic fluid.

5. A method of operating a hydraulic system comprised of a hydraulically driven load pressurized by hydraulic fluid flowing under pressure from a variable displacement pressure compensated pump having a destroking mode, wherein a directional control valve is disposed between the variable displacement, pressure-compensated pump and the hydraulically driven load and wherein the pump delivers pressurized hydraulic fluid at a system operating pressure which has a maximum level substantially greater than the maximum level of the load-driving pressure required to move the load, the improvement comprising the steps of:

setting the system operating pressure at the maximum continuous operating pressure at the pump outlet by disposing a poppet valve in an exhaust passage so that the hydraulic system operates at full flow when at maximum system pressure;

bleeding the load pressure signal through the poppet valve continuously to the exhaust passage in the directional control valve to destroke the system rapidly; and setting the maximum pump pressure when the pump is in a destroke mode at a level higher than the maximum continuous operating pressure.

6. The method of claim 5, wherein the step of setting the system operating pressure at the maximum continuous operating pressure comprises monitoring the system operating pressure at a work port of the directional control valve to provide a load pressure signal indicative thereof, delivering the load pressure signal to a pressure compensator connected to the pump, relieving the load pressure signal at a pressure level less than the maximum level of the system operating pressure to provide a reduced load pressure signal, adding the reduced load pressure signal to provide a force which, when added to a selected spring force in the pressure compensator, provides a force which destrokes the pump.

* * * * *